US009423181B2

(12) United States Patent
Jacques

(10) Patent No.: US 9,423,181 B2
(45) Date of Patent: Aug. 23, 2016

(54) APPARATUS FOR DRYING SPORTING EQUIPMENT

(71) Applicant: 16 & 8 SPORTS INC., London (CA)

(72) Inventor: Christine Jacques, Ilderton (CA)

( * ) Notice: Subject to any disclaimer, the term of this patent is extended or adjusted under 35 U.S.C. 154(b) by 0 days.

(21) Appl. No.: 14/580,120

(22) Filed: Dec. 22, 2014

(65) Prior Publication Data

US 2015/0176899 A1 Jun. 25, 2015

Related U.S. Application Data

(60) Provisional application No. 61/918,773, filed on Dec. 20, 2013.

(51) Int. Cl.

| | |
|---|---|
| ***F26B 25/18*** | (2006.01) |
| ***A47B 61/04*** | (2006.01) |
| ***A47B 81/00*** | (2006.01) |
| ***A47B 43/00*** | (2006.01) |
| ***D06F 57/06*** | (2006.01) |
| ***F26B 21/00*** | (2006.01) |
| *D06F 57/12* | (2006.01) |

(52) U.S. Cl.

CPC ..... *F26B 25/18* (2013.01); *A47B 43/003* (2013.01); *A47B 61/04* (2013.01); *A47B 81/00* (2013.01); *D06F 57/06* (2013.01); *F26B 21/004* (2013.01); *F26B 21/008* (2013.01); *D06F 57/12* (2013.01); *F26B 2210/00* (2013.01)

(58) Field of Classification Search

CPC ..... F26B 25/18; A47B 61/04; A47B 61/003; A47B 47/02; A47B 81/00

USPC ..... 211/90.01, 90.04, 113, 88.01; 223/87, 223/88, 85; 108/106–110

See application file for complete search history.

(56) References Cited

U.S. PATENT DOCUMENTS

| | | | | | |
|---|---|---|---|---|---|
| 1,914,967 | A * | 6/1933 | Bebb | 432/259 | |
| 2,672,988 | A * | 3/1954 | Johnson | B60N 3/007 108/46 | |
| 4,129,218 | A * | 12/1978 | Koellner | A47G 25/18 211/116 | |
| 4,311,243 | A * | 1/1982 | Hui-Lai | 211/113 | |
| 4,765,495 | A * | 8/1988 | Bisk | 211/113 | |
| 4,778,088 | A * | 10/1988 | Miller | A47G 25/48 211/113 | |
| 5,180,067 | A * | 1/1993 | Conaway | A47K 5/04 211/119 | |
| 5,542,530 | A * | 8/1996 | Freelander | 206/292 | |
| 5,617,962 | A * | 4/1997 | Chen | 211/206 | |
| 6,497,331 | B1 * | 12/2002 | Morandi | 211/153 | |
| 6,523,707 | B2 * | 2/2003 | Liu | 211/206 | |

(Continued)

*Primary Examiner* — Brian Glessner
*Assistant Examiner* — Paola Agudelo

(57) ABSTRACT

An apparatus for drying sporting equipment has at least two hangers removably positionable in a spaced-apart configuration on a substantially horizontal hanger support. Each hanger has one or more hanger protrusions and/or hanger apertures for hanging sporting equipment. At least one flexible connector mounted on each of the hangers connects a shelf to the hangers so that the shelf is suspended below the hangers when the hangers are positioned on the horizontal hanger support. The shelf has a plurality of interior through apertures through which sporting equipment may hang supported by the shelf and the shelf further has one or more shelf protrusions for hanging sporting equipment. A system for drying sporting equipment has a free-standing base, spaced-apart telescoping struts connected to and extending upwardly from the base, a substantially horizontal hanger support connecting the telescoping struts and an apparatus as described above configured to hang from the hanger support.

17 Claims, 5 Drawing Sheets

(56) References Cited

U.S. PATENT DOCUMENTS 6,729,509 B1 * 5/2004 Fabian ..... 223/85
7,798,341 B2 * 9/2010 Richardson et al. ..... 211/119
2003/0132258 A1 * 7/2003 Viazanko et al. ..... 223/85
2005/0269377 A1 * 12/2005 Ali et al. ..... 223/88

* cited by examiner

APPARATUS FOR DRYING SPORTING EQUIPMENT

CROSS-REFERENCE TO RELATED APPLICATION

This application claims the benefit of U.S. patent application 61/918,773, filed on Dec. 20, 2013, which is incorporated herein by reference.

FIELD

This application relates to an apparatus for drying sporting equipment, in particular hockey equipment.

BACKGROUND

Properly drying out sporting equipment, whether at home or while traveling, is a problem for both professional and non-professional athletes. Incompletely dried equipment can become a breeding ground for bacteria leading to diseases, especially skin diseases and conditions, and to the development of unpleasant odors.

There are a number of drying apparatuses for sporting equipment available on the market and proposed in the art. These apparatuses suffer from one or more drawbacks as follows: high cost, assembly required, lack of portability, insufficient structural strength, insufficient capacity to properly dry a full set of equipment and taking up too much space with less drying surface.

There remains a need for an apparatus for drying sporting equipment that addresses one or more of these drawbacks.

SUMMARY

An apparatus for drying sporting equipment comprises: at least two hangers removably positionable in a spaced-apart configuration on a substantially horizontal hanger support, each hanger comprising one or more hanger protrusions and/or hanger apertures for hanging sporting equipment therefrom; at least one flexible connector mounted on each of the at least two hangers; and, a first shelf connected to the at least two hangers by the flexible connectors, the first shelf suspended below the at least two hangers when the at least two hangers are positioned on the horizontal hanger support, the first shelf comprising a plurality of interior through apertures through which sporting equipment may hang supported by the first shelf, the first shelf further comprising one or more shelf protrusions for hanging sporting equipment thereon.

A system for drying sporting equipment comprises: a free-standing base; at least two spaced-apart telescoping struts connected to and extending upwardly from the base; a substantially horizontal hanger support connecting at least two of the telescoping struts; and, an apparatus as defined above configured to hang from the hanger support.

Compared to prior art drying apparatuses, the apparatus provided herein provides one or more of lower cost, no assembly required, portability, sufficient structural strength for all equipment including heavy equipment such as skates, sufficient capacity to properly dry a full set of equipment and taking up less space with more drying surface Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example without limiting the generality of the foregoing description, and with reference to the accompanying drawings, in which.

DETAILED DESCRIPTION

Figure 1:
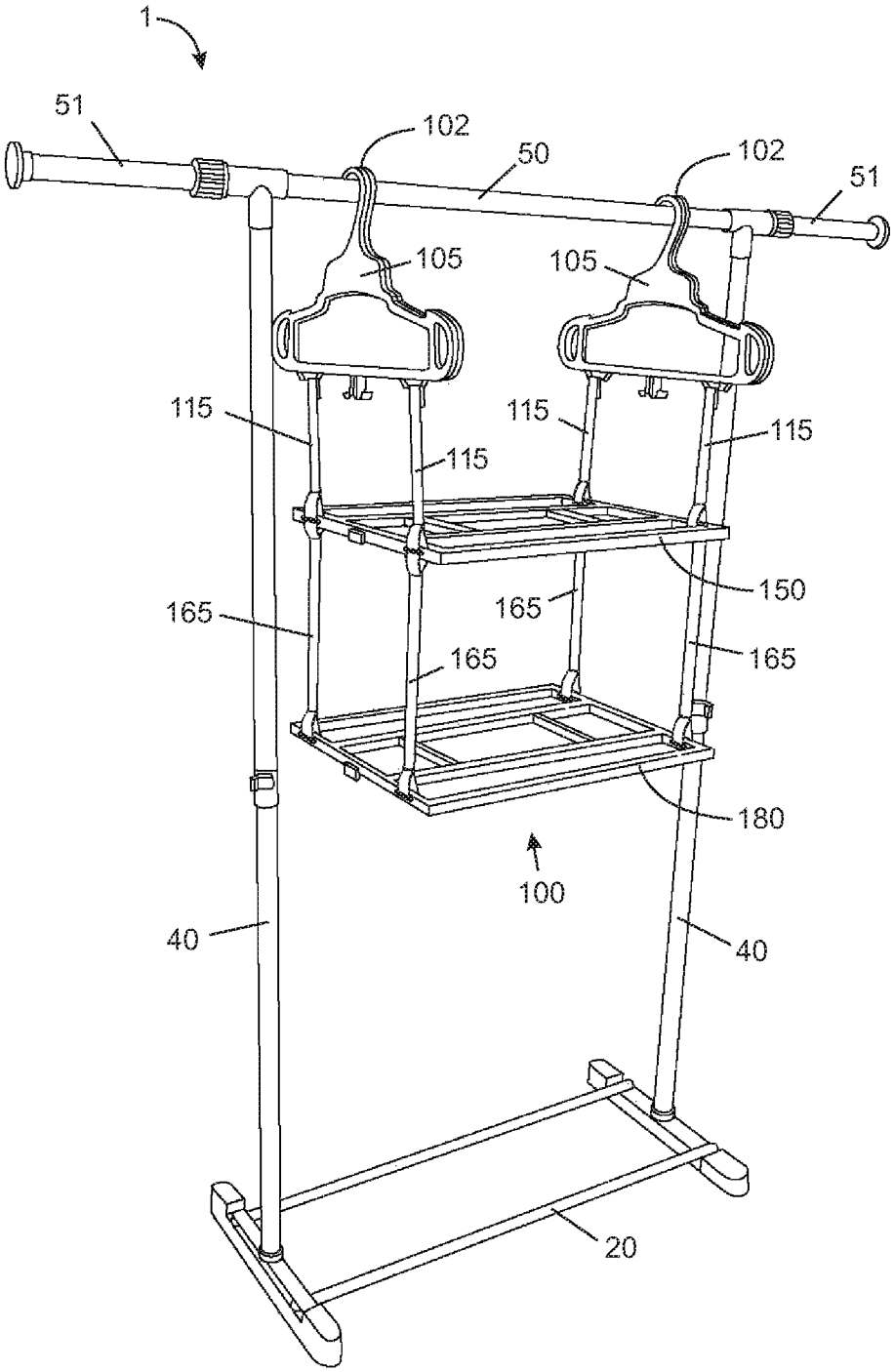
FIG. 1 is a perspective view of a system for drying sporting equipment having an apparatus for drying sporting equipment.

The apparatus comprises at least two hangers. More than two hangers, for example, three, four, five or more hangers may be used, but two hangers are preferred. The hangers comprise one or more hanger protrusions and/or hanger apertures for hanging sporting equipment therefrom. Each hanger preferably comprises at least one hanger protrusion from which sporting equipment can hang and at least one hanger aperture in which sporting equipment can be supported. Preferably, there is one larger hanger aperture, although two, three or more other hanger apertures may be present. The hanger apertures may be used to hang gloves, boots, cleats, pants, jocks and the like, but are particularly well suited for receiving and supporting large gloves, for example hockey gloves. Preferably the hanger comprises a plurality of hanger protrusions, for example two hanger protrusions, or three hanger protrusions or more, from which sporting equipment may be hung. The hanger protrusions may be clips, hook-shaped, straight, or any other suitable shape to receive sporting equipment, for example pads (e.g. knee pads, shin pads, shoulder pads, elbow pads and the like). The hanger protrusions may protrude from any portion of the hanger, for example one or more of the edges of the hanger. A hanger is preferably shaped as a typical coat hanger with a least one hanger aperture therein defined by a substantially triangular frame. The hanger may have a hook for removably positionably supporting the hanger on the horizontal hanger support. The hook may protrude upward from an apex of the triangular frame as in a typical coat hanger. The at least two hangers may be spaced apart when hung from the substantially horizontal hanger support to provide balanced support for the shelf or shelves suspended below in such a manner that the shelf or shelves remain substantially horizontal when suspended from the hangers. The hangers may have one or more connector mounts to which the at least one flexible connector is mounted. The connector mounts may be apertures, hooks or other protrusions.

The at least one flexible connector is mounted on each of the at least two hangers in any suitable manner, for example by tying or wrapping the flexible connector on the hanger, for example a frame element of the substantially triangular frame. Preferably, the flexible connectors are mounted at the one or more connector mounts of the hangers. Preferably there are two flexible connectors on each hanger. Preferably the flexible connectors on each hanger are spaced apart on the hanger in a direction substantially perpendicular to the horizontal hanger support on which the hangers are removably positioned. This arrangement provides greater stability to the shelf or shelves suspended below the hangers. The flexible connectors are preferably sufficiently flexible that the entire apparatus may be collapsed together when not in use without needing to disconnect the connectors. The flexible connectors may be straps, ropes, belts, strips or the like. The flexible connectors may comprise cloth, rubber or any other material the can be coiled, folded or bunched to permit compacting of the apparatus. The flexible connectors are preferably straps, for example cloth straps. Sporting equipment may be hung from the flexible connectors, for example by tying the sporting equipment to the connectors.

The apparatus comprises at least one shelf connected to at least two hangers by the at least one flexible connector mounted on each hanger. The flexible connectors may be secured to the shelf in any suitable manner, for example by tying or wrapping the flexible connector on the shelf, for example on a frame element of the shelf or at one or more connector mounts of the shelf. Preferably, the shelf comprises an outer frame having connector apertures therein for receiving the flexible connectors. The outer frame may comprise an outer edge and an inner edge and the connector apertures may be through apertures through the outer frame between the outer and inner edges through which the flexible connectors are mounted to connect the shelf to the hangers. The apparatus may comprise more than one shelf, for example two, three, four or more shelves. Preferably, the apparatus comprises two shelves. Each shelf may be different from or substantially identical to any other shelf in the apparatus.

Preferably, each extra shelf is connected by flexible connectors to an immediately preceding shelf such that the shelves form a vertical series, preferably a series where each shelf is suspended directly below the shelf above, when the apparatus is hung from the hanger support. Thus, the first shelf would be suspended under the hangers, a second shelf would be suspended under the first shelf, a third shelf would be suspended under the second shelf, and so forth. While a given flexible connector may be a continuous length of material connecting all of the shelves to the hangers, it is preferable that each shelf is connected above and below by different flexible connectors. For example, the second shelf may be flexibly connected to the first shelf by different flexible connectors than the flexible connectors connecting the first shelf to the hangers. The flexible connectors extending up and down may be mounted at different locations on the shelf or at the same location. Preferably, the same connector mounts on a shelf may accommodate both the flexible connector extending upwardly and the flexible connector extending downwardly. For example, the flexible connectors connecting the second shelf to the first shelf may be mounted through the connector apertures of the first shelf, the connector apertures of the first shelf also being used to mount the flexible connectors connecting the first shelf to the hangers.

The shelf comprises a plurality of interior through apertures through which sporting equipment may hang supported by the shelf. The plurality of interior through apertures may be defined by the outer frame and at least one interior frame element, the outer frame and the interior frame element providing support for the sporting equipment while permitting portions of the equipment to hang through the interior through apertures. There may be one, two, three, four or more interior frame elements defining any number of interior through apertures, for example, two, three, four or five interior through apertures. The shelf has an area and the plurality of interior through apertures preferably comprises at least 50% of the area, more preferably at least 75% of the area. The area may be defined by the perimeter dimensions of the shelf. One or more of the interior frame elements may be moveable and/or removable to provide more or fewer interior through apertures and/or interior through apertures of alternate dimensions. Various arrangements for moveable and/or removable interior frame elements may be employed, for example, elastic cords (e.g. bungee cords), elongated elements with pin and hole structures, elongated elements with track and slide structures, and the like. The shelf may be made of any suitably durable and moisture resistant material, for example a plastic (e.g. polycarbonate), aluminum, and the like. The outer frame and/or interior frame elements may be solid pieces, or hollow pieces in whole or in part to reduce weight and cost. The shelf may comprise a single molded part or comprise two or more parts that may be secured together. If the shelf comprises two or more parts, the parts may be secured together by one or more fasteners, for example welds, snaps, clips, screws, bolts, rivets, adhesives and the like.

The shelf also comprises one or more shelf protrusions, for example one shelf protrusion, or two shelf protrusions, or three shelf protrusions or more, for hanging sporting equipment thereon. The shelf protrusions may be clips, hook-shaped, straight, or any other suitable shape to receive sporting equipment, for example pads (e.g. knee pads, shin pads, shoulder pads, elbow pads and the like). The shelf protrusions may protrude from any portion of the shelf, for example one or more of outer frame or interior frame elements. The shelf protrusions may protrude upward, downward or outward from the shelf, or inward into an interior through aperture, or any combination thereof. The shelf protrusions may comprise an elongated element suited for hanging a jersey. Preferably, at least one shelf protrusion protrudes outward from the shelf from the outer frame. Preferably, the at least one shelf protrusion also comprises an elongated element extending upwardly for hanging a jersey. The number of protrusions including hanger and shelf protrusions on the apparatus is greater than the number of protrusions on prior art drying apparatuses.

The apparatus may be comprised of an integrally formed single piece or assembled from parts. Either way, the apparatus may be packaged in a ready-to-use manner so that the end consumer does not need to assemble anything. Each hanger and shelf is preferably made of a strong material and preferably has an ultimate tensile strength of at least 500 kPa, more preferably at least 700 kPa. The shelves, flexible connectors and hangers together may provide at least 1.5 times more drying space, or at least 2 times more drying space, or at least 3 times more drying space than prior art apparatuses while taking up less overall space. Thus, the drying surface to total volume ratio of the apparatus is greater than prior art apparatuses. The apparatus may provide at least 2 meters of drying space, preferably at least 4 meters of drying space, more preferably at least 6 meters of drying space. Further, the apparatus is lighter than prior art apparatuses and can collapse to a size that is easily transported for travel.

In addition to the apparatus, the system for drying sporting equipment comprises a free-standing base, at least two spaced-apart telescoping struts connected to and extending upwardly from the base and a substantially horizontal hanger support connecting at least two of the telescoping struts. Because the apparatus can be hung from any horizontal hanger support in any location, for example shower rods, closet rods, wooden dowels supported on J-hooks and the like at home, in hotel rooms, in locker rooms and the like, the apparatus does not need to be used in association with the other components of the system, which is useful for travel, but the system provides certain benefits. The base is free-standing; therefore the system can be moved to different locations and could, if desired, be transported during travel as well. The base is preferably a single unit from which all of the struts extend. The upwardly extending telescoping struts and the hanger support may be dismantleable from the base for ease of transport. The telescoping struts permit raising the hanger support to a greater height, which ensures that the sporting equipment does not touch the ground and may also permit utilization of more shelves in the apparatus. The telescoping struts preferably extend substantially vertically from the base. There are preferably two telescoping struts between which the apparatus would hang when the apparatus is removably positioned on the hanger support. The hanger support preferably connects the telescoping struts proximate the top of the struts. The hanger support may extend horizontally beyond the struts, which permits supporting even more sporting equipment for drying. The hanger support is preferably telescoping beyond the struts, which permits yet even more sporting equipment to be dried. The hanger support is preferably a rod.

The apparatus and system are useful for drying any type of sporting equipment, for example hockey equipment, football equipment, soccer equipment, ski equipment, baseball equipment, and the like. The apparatus and system are especially well suited for drying hockey equipment. For example, for hockey equipment, at least two of the interior though apertures may be configured to support hockey skates with the skates turned upside down with blades pointing up and the ankle support pointing down through the through aperture. A hockey helmet may rest on one of the shelves, gloves may be inserted into the hanger apertures, and pads may be tied to, hung from or otherwise mounted on the hanger protrusions and shelf protrusions. Jerseys, pants, undershirts, stockings, socks and other clothing items may be draped over the outer frame or inner frame elements to hang down through the interior through apertures.

Figure 2:
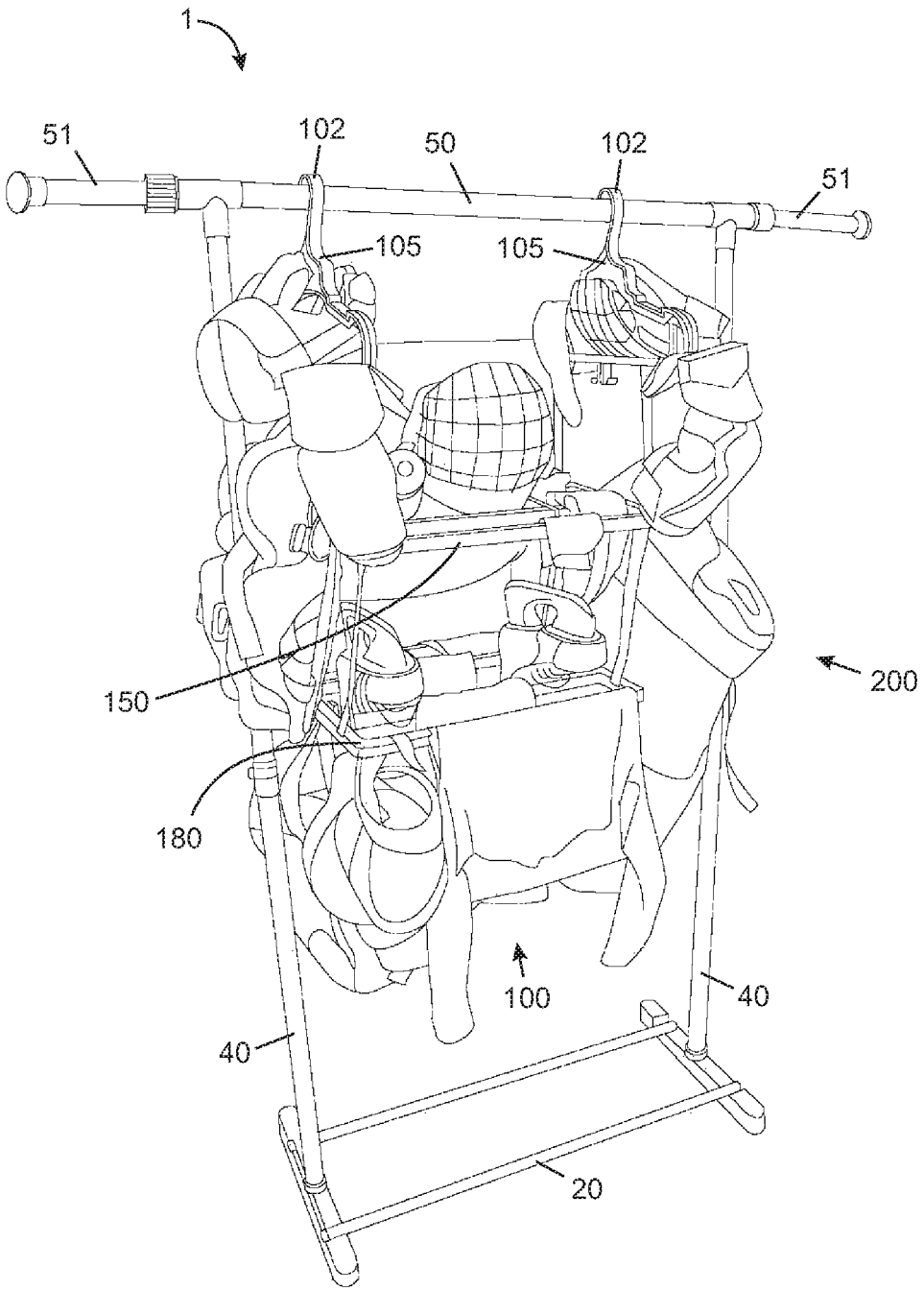
FIG. 2 depicts the system and apparatus of FIG. 1 with hockey equipment supported thereon.
Figure 3:
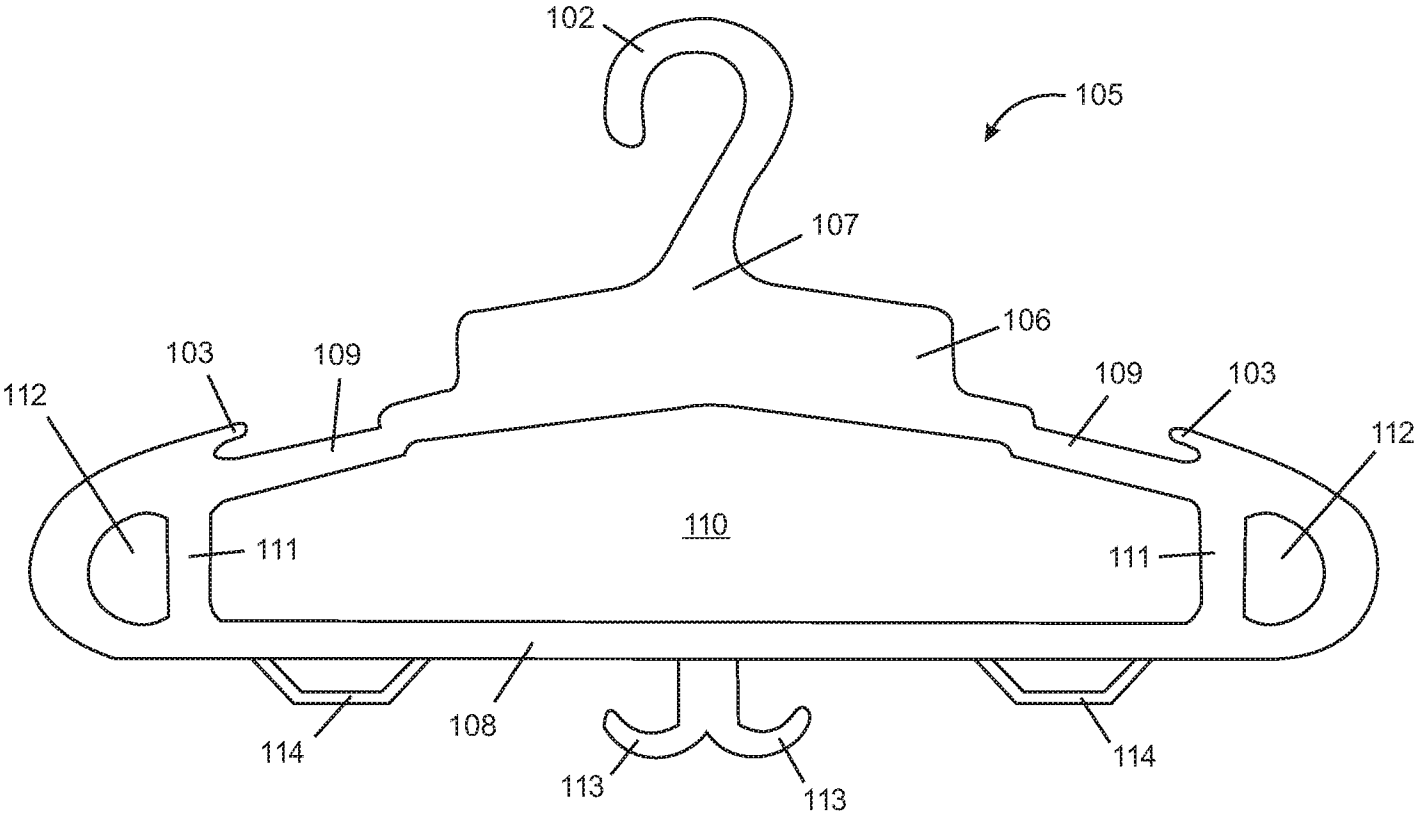
FIG. 3 depicts a hanger for an apparatus for drying sporting equipment.
Figure 4A:
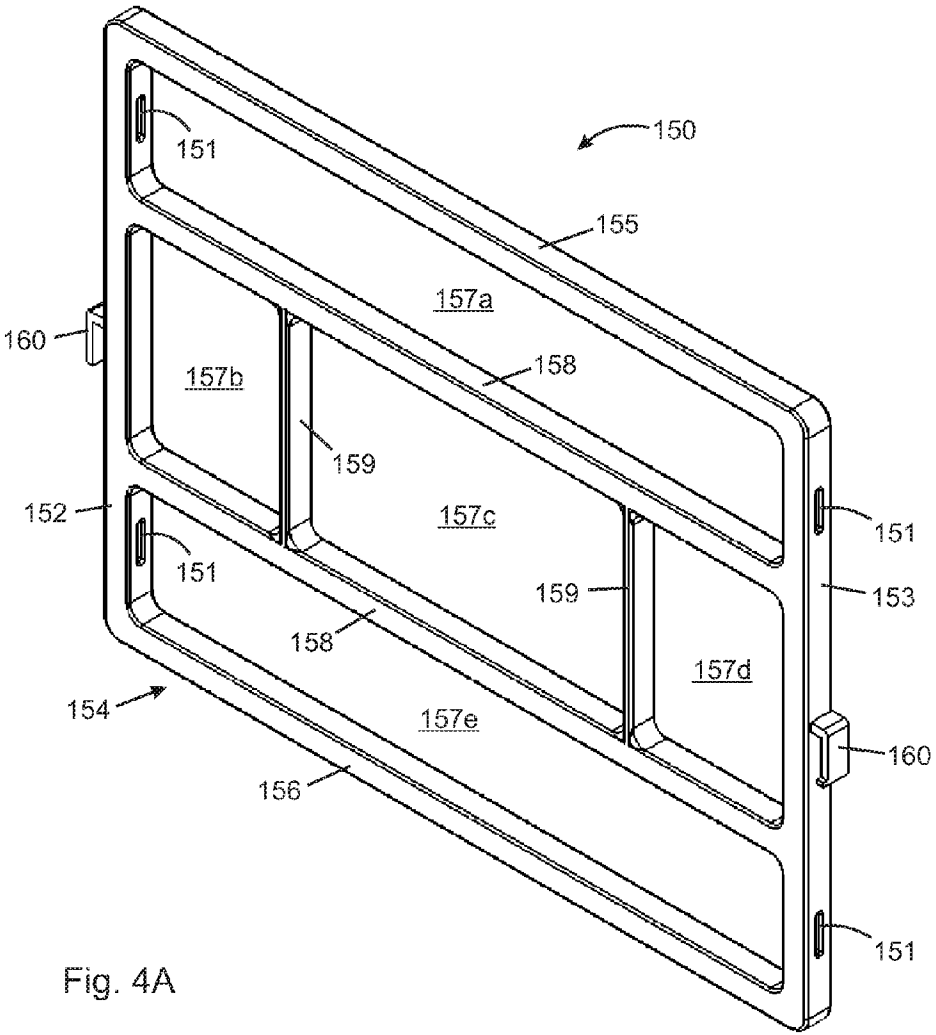
FIG. 4A is a perspective view of a shelf for an apparatus for drying sporting equipment.
Figure 4D:
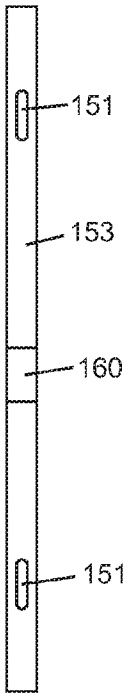
FIG. 4D is an end view of the shelf of FIG. 4A.
Figure 4C:
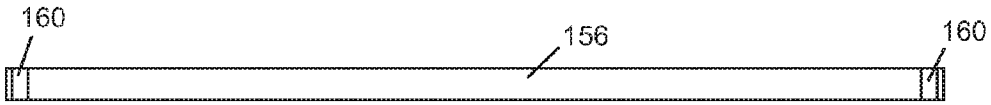
FIG. 4C is a side view of the shelf of FIG. 4A.
Figure 4B:
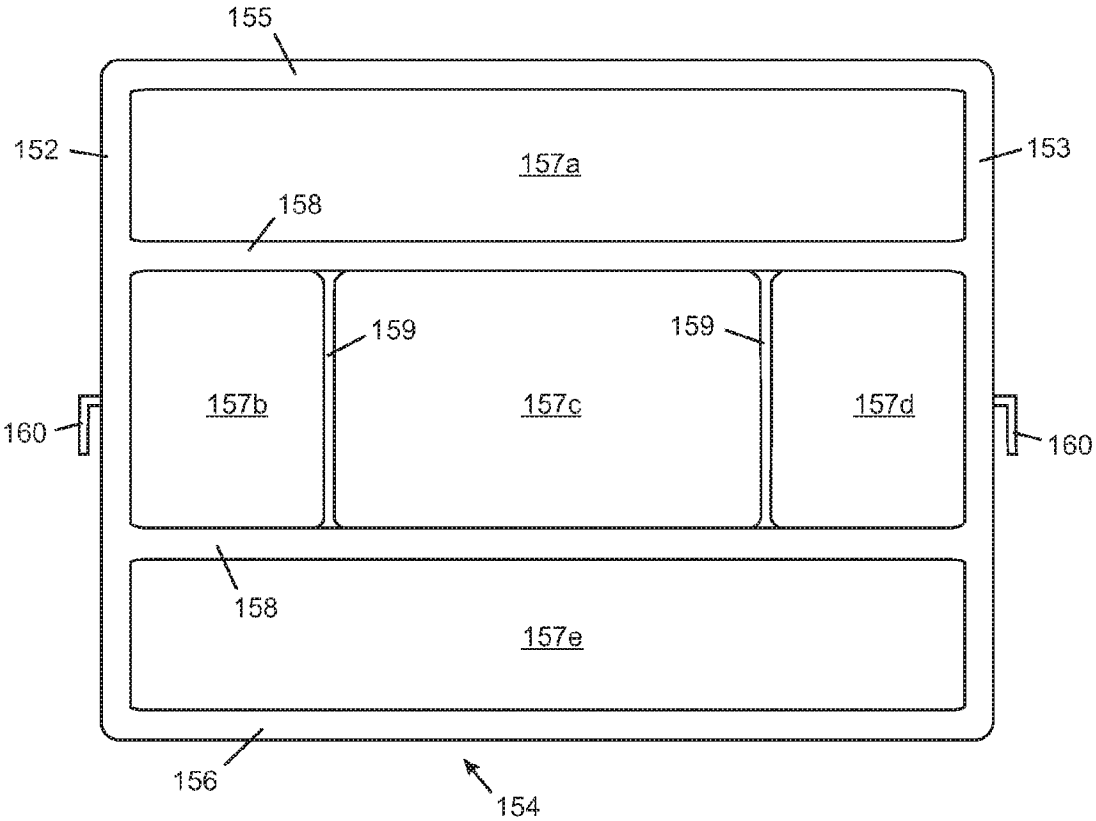
FIG. 4B is a top view of the shelf of FIG. 4A.

Referring to FIG. 1, FIG. 2, FIG. 3 and FIGS. 4A-D, an embodiment of a drying system 1 for drying sporting equipment comprises a drying apparatus 100 for drying sporting equipment in the system 1. FIG. 2 illustrates hockey equipment 200 supported on the apparatus 100 of the system 1. FIG. 3 illustrates in more detail a hanger 105 of the apparatus 100 and FIGS. 4A-D illustrates in more detail a shelf 150 of the apparatus 100. While the apparatus 100 is shown in the context of the system 1, it is evident to one skilled in the art that the apparatus 100 could be used wherever there is a suitable rod or the like (e.g. a shower rod) from which to hang the apparatus 100.

In the embodiment shown in FIG. 1 and FIG. 2, the apparatus 100 for drying sporting equipment, especially hockey equipment, comprises two hangers 105 having hooks 102 that engage horizontal rod 50 to suspend the drying apparatus 100 from the rod 50. As best seen in FIG. 3, each hanger 105 has a substantially triangular frame 106 having a bottom 108 and two sides 109 meeting at an apex 107 from which the hook 102 extends. The bottom 108 and the two sides 109 of the triangular frame 107 define a large aperture 110 in which sporting equipment like hockey gloves may be supported (see FIG. 2). The large aperture 110 is sectioned by crossbars 111 proximate the vertices where the bottom 108 meets the two sides 109 to form smaller apertures 112 in which other sporting equipment like elbow pads may be supported (see FIG. 2). Two clips 113 protruding downward from the bottom 108 of the hanger 105 proximate a center of the bottom 108 are utilized to support more sporting equipment like shin pads (see FIG. 2). Two side clips 103 protruding from the sides 109 may also be used to support more sporting equipment like socks. Two strap mounts 114 protruding downward from the bottom 108 of the hanger 105 proximate each end of the bottom 108 have flexible cloth straps 115 secured thereto (see FIG. 1).

As best seen in FIG. 1 and FIGS. 4A-D, the four straps 115 secured to the two hangers 105, two straps per hanger, are also secured to a top shelf 150 so that the top shelf 150 is suspended below the hangers 105 and remains substantially horizontal. The four straps 115 are secured to the top shelf 150 through four strap apertures 151, the straps passing horizontally through a corresponding horizontal shelf aperture, two through one outer frame width element 152 and two through an opposing outer frame width element 153 of the top shelf 150. As best seen in FIGS. 4A-D, the shelf 150 comprises a substantially rectangular outer frame 154 comprising opposed outer frame width elements 152,153 connected to opposed outer frame length elements 155,156 defining a through aperture 157 (labelled as 157*a-e*) through the shelf 150, the through aperture being subdivided into five smaller through apertures 157*a-e* by two substantially parallel longitudinal interior elements 158 extending between the opposed outer frame width elements 152,153 and two substantially parallel transverse interior frame elements 159 extending between the two longitudinal interior elements 158. The shelf 150 further comprises two clips 160, one protruding outwardly from each of the outer frame width elements 152,153.

Another four straps 165 secured to the top shelf 150 through four strap apertures 151, two on outer frame width element 152 and two on outer frame width element 153 extend downwardly and are secured to a bottom shelf 180 to suspend the bottom shelf 180 directly below the top shelf 150. The bottom shelf 180 is identical in construction to the top shelf 150. As seen in FIG. 2, the shelves 150,180 are able to support sporting equipment like a helmet, skates, a jersey, shirts, socks, pants and shoulder pads. Central aperture 157*c* of the shelves is well suited for supporting a helmet, while flanking apertures 157*b*,157*d* are well suited for supporting skates. The opposed outer frame length elements 155,156 are well suited for supporting articles of clothing as they act like bars over which clothing may be hung. The clips 160 assist in hanging shoulder pads on the shelf.

As best seen in FIG. 1, the drying apparatus 100 is suspended from the horizontal rod 50. The horizontal rod 50 is secured proximate a top of two vertical telescoping poles 40 extending upward from a base 20. The horizontal rod 50 extends between and beyond two vertical telescoping poles 40. The horizontal rod 50 is capable of telescoping in the portions 51 beyond the vertical poles 40 to provide extra space from which to hang sporting equipment. The telescoping poles 40 permit adjusting the height of the apparatus 100 off the ground so that equipment does not touch the ground. The base 20 is a single piece to provide stability to the system 1. The base 20, poles 40 and rod 50 may be dismantled for storage and packing.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. An apparatus for drying sporting equipment comprising:

at least two hangers each having a substantially triangular frame comprising a bottom and two sides meeting at an apex from which a hook extends, the hangers removably positionable in a spaced-apart configuration on a substantially horizontal hanger support, each hanger comprising one or more hanger protrusions and/or hanger apertures for hanging sporting equipment therefrom;

a first set of four flexible connectors mounted on the at least two hangers; and, a first shelf having a rectangular outer frame comprising opposed outer frame length elements and outer frame width elements connected to the at least two hangers by the first set of four flexible connectors, each of the connectors of the first set of four flexible connectors passing horizontally through a corresponding horizontal shelf aperture located in the outer frame, the first shelf suspended below the at least two hangers when the at least two hangers are positioned on the horizontal hanger support, the first shelf consisting essentially of five interior through apertures having sizes through which sporting equipment may hang supported by the first shelf, the interior through apertures defined by structure consisting essentially of the outer frame and two substantially parallel longitudinal interior elements extending between the opposed outer frame width elements and two substantially parallel transverse interior frame elements extending between the two longitudinal interior elements, the outer frame and the interior frame elements providing support for the sporting equipment while permitting portions of the equipment to hang through the interior through apertures, an interior through aperture sized and configured to support a skate with the skate turned upside down with ankle support pointing down through the through aperture, the first shelf further comprising one or more L-shaped shelf clips for hanging sporting equipment thereon;

a second set of four flexible connectors different from the first set of four flexible connectors, the second set of four flexible connectors mounted on the first shelf; and, a second shelf having a rectangular outer frame connected to the first shelf by the second set of four flexible connectors, each of the connectors of the second set of four flexible connectors passing horizontally through a corresponding horizontal shelf aperture located in the outer frame of the second shelf, the second shelf suspended below the first shelf.

2. The apparatus according to claim 1, wherein all of the flexible connectors comprise straps from which sporting equipment may hang.

3. The apparatus according to claim 1, wherein each hanger and shelf has an ultimate tensile strength of at least 500 kPa.

4. The apparatus according to claim 1, wherein the first shelf has an area and the plurality of interior through apertures comprises at least 50% of the area.

5. The apparatus according to claim 4, wherein the plurality of interior through apertures comprises at least 75% of the area.

6. The apparatus according to claim 1, wherein the sporting equipment is hockey equipment.

7. A system for drying sporting equipment comprising: a free-standing base; at least two spaced-apart telescoping struts connected to and extending upwardly from the base; a substantially horizontal hanger support connecting at least two of the telescoping struts; and, an apparatus as defined in claim 1 configured to hang from the hanger support.

8. The system according to claim 7, wherein the struts extend substantially vertically from the base and the hanger support connects the struts proximate the top of the struts.

9. The system according to claim 7, wherein the hanger support extends horizontally beyond the struts and is telescoping beyond the struts.

10. The system according to claim 7, wherein the hanger support comprises a rod.

11. The apparatus according to claim 1, wherein the first shelf further comprises two L-shaped clips, one L-shaped clip extending outwardly from a center of each outer frame width element.

12. The apparatus according to claim 1, wherein each horizontal shelf aperture passes horizontally through an outer frame width element.

13. The apparatus according to claim 1, wherein two of the interior frame apertures have a length substantially equal to a length of the outer frame length elements and wherein another two of the interior frame apertures have a length less than that of the outer frame length elements and equal to each other.

14. The apparatus according to claim 1, wherein each hanger further comprises two strap mounts protruding downwardly from the bottom, a connector of the first set of four flexible connectors passing through each strap mount.

15. The apparatus according to claim 1, wherein each hanger comprises crossbars proximate the vertices where the bottom meets the two sides to thereby form a large aperture and two smaller apertures configured for supporting sporting equipment.

16. The apparatus according to claim 1, wherein each hanger comprises a side clip protruding from each side configured for supporting sporting equipment.

17. The apparatus according to claim 1, wherein each hanger further comprises a clip protruding downwardly from a center of the bottom.

* * * * *